US009598156B2

(12) United States Patent
Ortwein et al.

(10) Patent No.: US 9,598,156 B2
(45) Date of Patent: Mar. 21, 2017

(54) WATERCRAFT LIGHT, HOUSING, AND METHOD

(71) Applicant: Night Fishing Solutions, LaGrange, KY (US)

(72) Inventors: Michael Scot Ortwein, Park Hills, KY (US); Chad Miles, Louisville, KY (US); Stephen Edwards, Crestwood, KY (US)

(73) Assignee: NIGHT FISHING SOLUTIONS, LaGrange, KY (US)

( * ) Notice: Subject to any disclaimer, the term of this patent is extended or adjusted under 35 U.S.C. 154(b) by 219 days.

(21) Appl. No.: 14/501,459

(22) Filed: Sep. 30, 2014

(65) Prior Publication Data

US 2016/0090158 A1 Mar. 31, 2016

(51) Int. Cl.
*B63B 45/04* (2006.01)
*B63B 59/02* (2006.01)

(52) U.S. Cl.
CPC ..... *B63B 45/04* (2013.01); *B63B 59/02* (2013.01)

(58) Field of Classification Search
CPC ..... B63B 45/02; B63B 45/04; B63B 2201/04
USPC ..... 362/477
See application file for complete search history.

(56) References Cited

U.S. PATENT DOCUMENTS

2010/0110681 A1* 5/2010 Wilcox ..... B63B 45/04 362/235
2010/0118557 A1* 5/2010 Ortwein ..... B60Q 1/32 362/477

* cited by examiner

*Primary Examiner* — Karabi Guharay
(74) *Attorney, Agent, or Firm* — Steve Witters; Witters & Associates

(57) ABSTRACT

A watercraft light, light housing, and method of installation is disclosed herein. The watercraft light comprises at least one light disposed in a unitary longitudinally extending housing having a first side and a second side. The first side of the housing comprises an outwardly extending portion configured to be placed into a rub rail track between separate sections of a rub rail bumper and to hold the at least one light substantially therein. The second side of the housing is configured to transfer light and comprises longitudinally extending portions that extend beyond each of the longitudinal ends of the outwardly extending portion of the first side. The watercraft light comprises a connector configured to connect and hold the watercraft light to the watercraft.

20 Claims, 7 Drawing Sheets

WATERCRAFT LIGHT, HOUSING, AND METHOD

FIELD OF THE DISCLOSURE

This invention generally relates to watercraft lights, and, more particularly, to watercraft lights, housings, and methods, such as watercraft lights configured to be installed with a rub rail of a watercraft.

BACKGROUND

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Watercraft lighting, such as navigation lights, have typically been installed on watercraft for many years. Navigation lights are colored source of illumination on a watercraft. For example, a red light may be mounted on the left or port side of the watercraft, a green may be mounted on the right or starboard side, and a white light may be mounted to shine from astern to two points abaft the beam on both sides.

Other watercraft lighting has been and is being used. For example, lights may be installed on a watercraft to illuminate the area around the watercraft. Typically, watercraft lights project from a surface or perimeter of the watercraft which may subject the watercraft lights to damage and/or be an inconvenience or obstacle.

SUMMARY

In at least one aspect of the present disclosure, a watercraft light is disclosed. The watercraft light comprises at least one light and a unitary longitudinally extending housing holding the at least one light substantially therein and having a first side and a second side. The first side of the housing comprises an outwardly extending portion configured to be placed into a rub rail track between separate sections of a rub rail bumper. The second side of the housing comprises longitudinally extending portions that extend beyond each of the longitudinal ends of the outwardly extending portion of the first side, each longitudinally extending portion is configured to cover and become adjacent end portions of the separate sections of rub rail bumper. The second side of the housing is configured to transfer light from the at least one light to an area to be illuminated. The watercraft light also has a connector configured to connect and hold the watercraft light to the watercraft.

In another aspect of the present disclosure, a unitary watercraft light housing configured to be held between sections of a watercraft rub rail bumper and to hold at least one light substantially therein is disclosed. The watercraft light housing comprises an outwardly extending portion configured to be placed into a portion of rub rail track void of a rub rail bumper, between separate sections of a rub rail bumper. The housing has a portion of its outer surface configured and disposed to cover an outer surface of end portions of the separate sections of a rub rail bumper. A connector configured to connect and hold the watercraft light housing to the watercraft is also provided.

In a further aspect of the present disclosure, a method of installing a watercraft light is disclosed. The method comprising the steps of: anchoring two spaced apart points of a rub rail bumper in a rub rail track on a watercraft; cutting and removing a portion of the rub rail bumper from the rub rail track, the portion being between the anchored points; inserting an outwardly extending portion of the watercraft light into the portion of the rub rail track having the rub rail bumper removed; covering the cut ends of the rub rail bumper with longitudinally extending portions of the watercraft light; electrically connecting the watercraft light to a power source; and connecting the watercraft light to the watercraft.

BRIEF DESCRIPTIONS OF THE DRAWINGS

The following figures, which are idealized, are not to scale and are intended to be merely illustrative of aspects of the present disclosure and non-limiting. In the drawings, like elements may be depicted by like reference numerals. The drawings are briefly described as follows.

DETAILED DESCRIPTION

Disclosed herein is a watercraft light, housing, and method of installation. The watercraft light of the present disclosure may be installed on a watercraft to be an illuminated section of a rub rail. A rub rail on a watercraft typically comprises a rub rail track holding a rub rail bumper. One or more lights may be held by a housing configured to be attached to a rub rail track on a watercraft and replace a displaced or removed section of the rub rail bumper. A portion of the housing may extend over the rub rail bumper.

Reference will now be made in detail to the present exemplary embodiments and aspects of the present invention, examples of which are illustrated in the accompanying figures. The same reference numbers may be used in the figures to refer to the same or like parts. The presently disclosed embodiments, aspects, and features of the present invention are not to limit the presently claimed invention as other and different embodiments, aspects, and features will become apparent to one skilled in the art upon reading the present disclosure.

Figure 1:
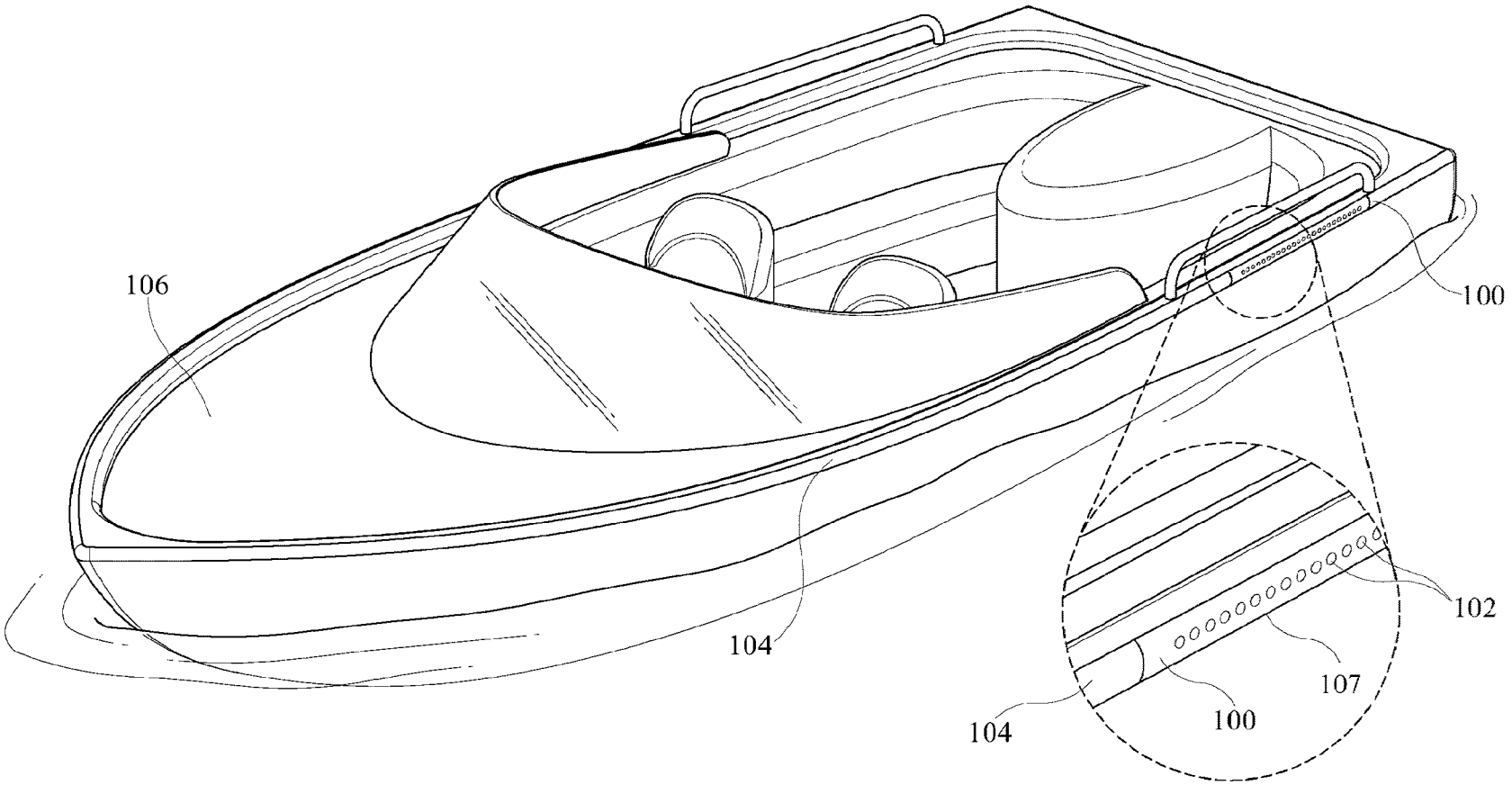
FIG. 1 is a perspective view of an installed watercraft light of the present disclosure.

FIG. 1 shows watercraft light 100 installed watercraft craft 106. Watercraft 106 may be a boat, Jet Ski, or other watercraft that may dispose one or more lights. Aspects of the watercraft light of present disclosure are configured to be fastened or connected to a watercraft with little or no alteration of the exterior surfaces of the watercraft. Thus, little or no portion of watercraft light 100 may project from the exterior surfaces or perimeter of watercraft 106. Having watercraft light 100 mounted substantially within its existing structure may minimize any potential of damage of watercraft light 100 and/or minimize any inconvenience or obstruction to a user of watercraft 106.

Watercraft light 100 is shown installed within a rub rail on watercraft 106. A rub rail typically comprises a rub rail track, 120, shown in FIG. 2, and a rub rail bumper 104. A rub rail track may be a separate component part of watercraft 106 or may be formed within its hull. Rub rail bumper 104 may comprise natural, synthetic, polymeric, metallic, or other materials as are known by persons having ordinary skill in the art. For example, rub rail bumper 104 may comprise a stretchable and/or cushioning material such as rubber or a polymeric rubber like material.

Watercraft light 100 is shown mounted in the rub rail of watercraft 106 and between separate sections of rub rail bumper 104. As shown in the enlarged sectional view in FIG. 1, watercraft light 100 is mounted in the rub rail to provide a substantially seamless extension between the separate sections of rub rail bumper 104. Incorporation of watercraft light 100 into the existing structure of watercraft 106 may minimize any potential of damage of watercraft light 100 and/or minimize any inconvenience or obstruction to a user of watercraft 106. Portions of watercraft light 100 may cover and may be adjacent ends of the separate sections of rub rail bumper 104.

Watercraft light 100 has a unitary longitudinally extending housing 107 holding at least one light 102. Watercraft light 100 may be configured to hold one or a plurality of lights 102. For example, watercraft light 100 may hold two, three, four, or more lights. In the aspect shown in the FIGS., watercraft light 100 is shown holding twenty four lights 102. It is to be understood than any number of lights 102 may be held with watercraft light 100.

Lights 102 may comprise any light source known, or that may become known, to persons having ordinary skill in the art. Lights 102 may have point or longitudinal extending light source. For example, light emitting diodes (LEDs) or quantum dots may provide point light sources and fluorescent lights may provide longitudinally extending light sources. An LED is a solid-state light that may comprise a conventional semiconductor light emitting diode or an organic or polymeric light emitting diode.

Lights 102 may be configured to provide white light or any color light. Additionally, watercraft light 100 may have one or more lenses or filters which may focus or alter the direction or may color the light to be emitted from lights 102. It is to be understood that watercraft light 100 may hold most any number of lights 102 and lights 102 may have any composition or configuration as in known, or becomes known, by persons having ordinary skill in the art.

Figure 2:
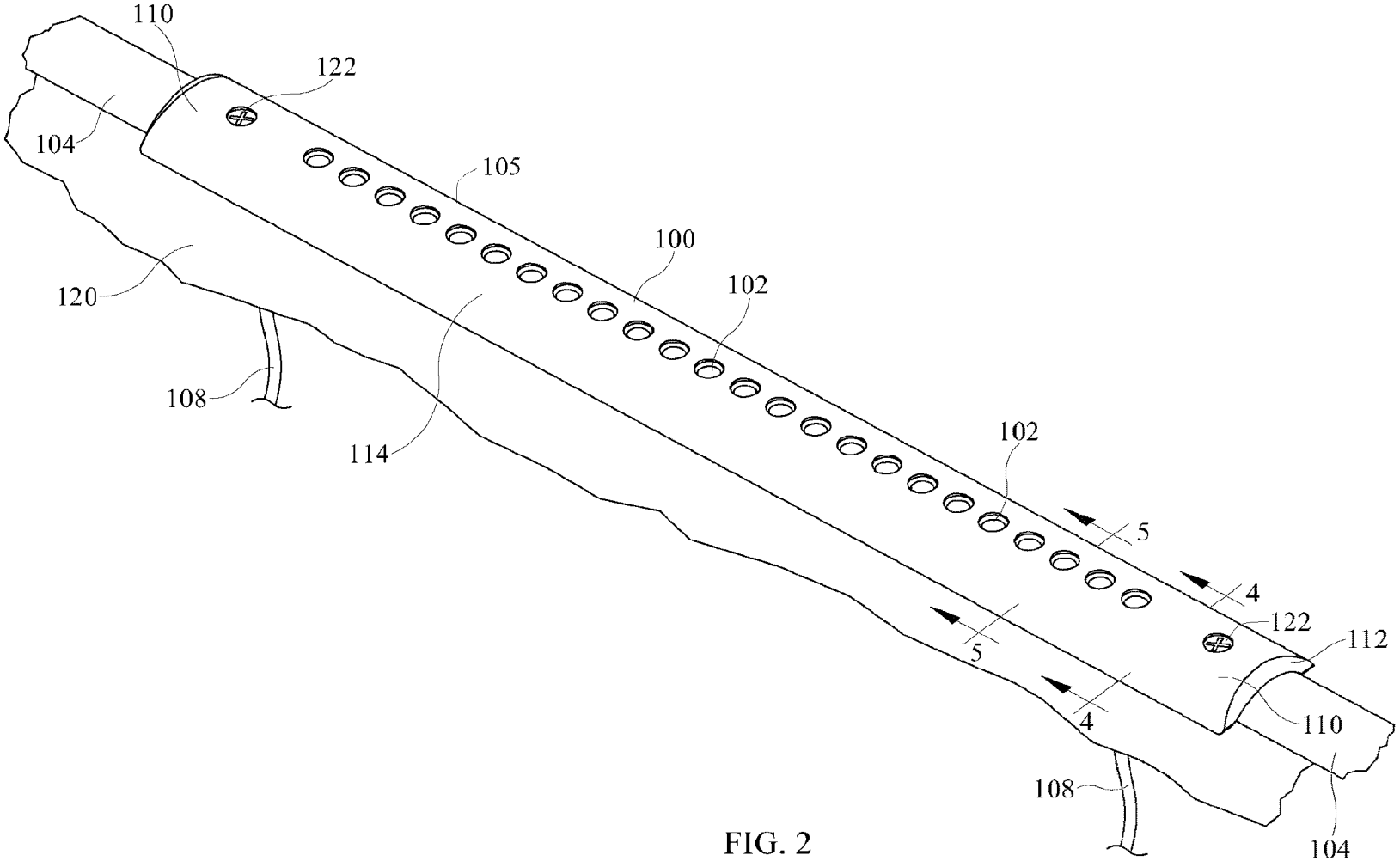
FIG. 2 is a perspective cut-away view of a portion of a watercraft having a watercraft light of the present disclosure installed therewith.

FIG. 2 shows a cut-away portion of a watercraft having watercraft light 101 installed therewith. Rub rail track 120 may be a portion of a watercraft or may be a separate component part of a watercraft. Watercraft light 101 is shown having unitary longitudinally extending housing 105 holding a plurality of lights 102 to rub rail track 120. It is to be understood that watercraft light 101 may have a string of lights or longitudinally extending light 103, as shown in FIG. 3.

Ends of sections of rub rail bumper 104 are covered with portions of watercraft light 101. A second side 114 of unitary longitudinally extending housing 105 has longitudinal extending portions 110 extending over and covering ends of rub rail bumper 104. Second side 114 of unitary longitudinally extending housing 105 may have beveled longitudinal ends 112. It is to be understood that second side 114 may be thin and/or flexible and may be otherwise configured to closely proximate or become coincident and/or adjacent with the outer surface of rub rail bumper 104, upon installation into rubrail track 120. For example, rub rail bumper 104 may have an arcing outer surface and second side 114 may have a substantially similar arcing outer surface, as shown in FIG. 3. Second side 114 may be configured to transfer light from the at least one light held with housing 105. For example, second side 114 may have one or more apertures disposed for transferring light to a surface to be illuminated. In the example shown in FIG. 2, an aperture is disposed in second side 114 for each light held with housing 105. However, it is to be understood that second side 114 of housing 105 may have a single aperture or translucent area disposed for emitting light from each of the at least one lights 102. For example, second side 114 may have a slot or longitudinally extending area configured and disposed for the transfer of light emitted from each light 102 held with housing 101.

Fasteners 122 are shown connecting and holding watercraft light 101 to rub rail track 120 or a watercraft. It is to be understood watercraft light 101 may comprise additional, other, or different fasteners as are known by persons having ordinary skill in the art for holding to a watercraft. For example, watercraft light 101 may be configured to snap into rub rail track 120, have a twist-n-lock, snap lock, or even may be held to a watercraft with adhesives. Watercraft light 101 may be configured to resist warping and separation from rub rail track 120. For example, watercraft light 101 may comprise connectors, fasteners, adhesives, or combinations thereof, at different points or sections of its longitudinal housing. Electrical lines 108 are shown extending through rub rail track 120 wherein they may be electrically connected with a power source of a watercraft.

Figure 3:
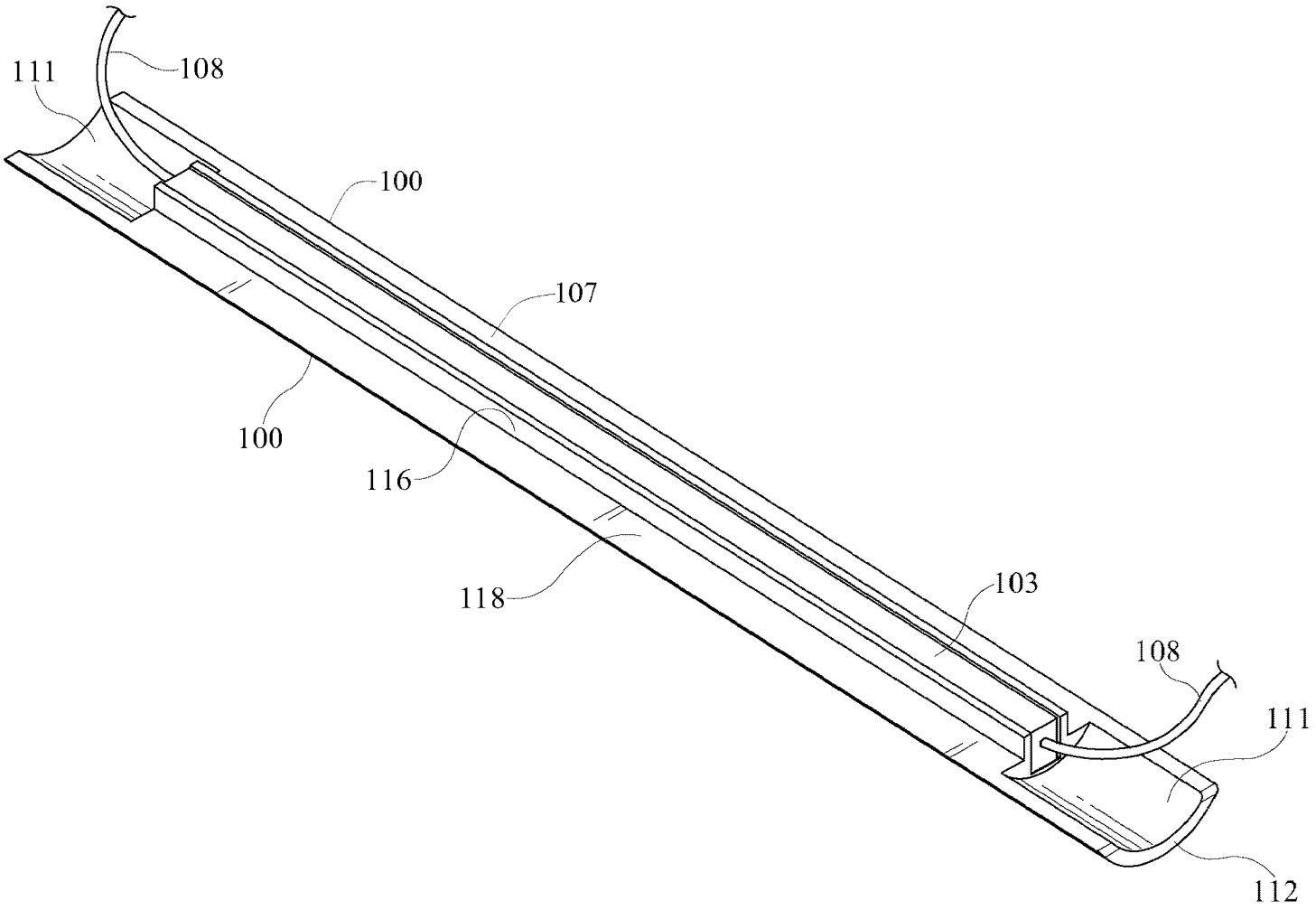
FIG. 3 is a lower perspective view of the watercraft light shown in FIG. 1.

FIG. 3 is a perspective view of watercraft light 100 showing outwardly extending portion 116. Unitary longitudinally extending housing 107 has outwardly extending portion 116 extending outwardly from first side 118. Outwardly extending portion 116 may be configured to hold one or more lights 102 or a string of lights 103. In at least one aspect of the present disclosure, each light 102 or lights 103 may be removable or replaceable. For example, as shown in FIG. 3, outwardly extending portion 116 may comprise two gap spaced substantially parallel ribs extending a portion of first side 118, between inner surfaces 111 of longitudinally extending portions 110. Outwardly extending portion 116 may be configured to be inserted into a rub rail track and removeably hold lights 103. Optionally, outwardly extending portion 116 may be configured to hold or connect watercraft light 100 to a watercraft. For example, as shown in FIG. 3, outwardly extending portion 116 may comprise gap spaced, substantially parallel longitudinally extending ribs configured to be placed into a rub rail track and connect therewith.

Also shown in FIG. 3 are electrical lines 108 extending from string of lights 103. It is to be understood that string of lights 103 may be a string of a plurality of point source lights or may be representative of other and different light sources. For example, a fluorescent light tube or an array of LEDs may be held with outwardly extending portion 116.

Additionally, a second side of the unitary longitudinally extending housing may have an open slot or other configuration for transferring light from at least one light held with outwardly extending portion 116, and/or other portions of unitary housing 107. The housing may comprise a light transmissible cover, configured and disposed to cover at least one light. Electrical lines 108 are also shown extending from string of lights 103.

Figure 4:
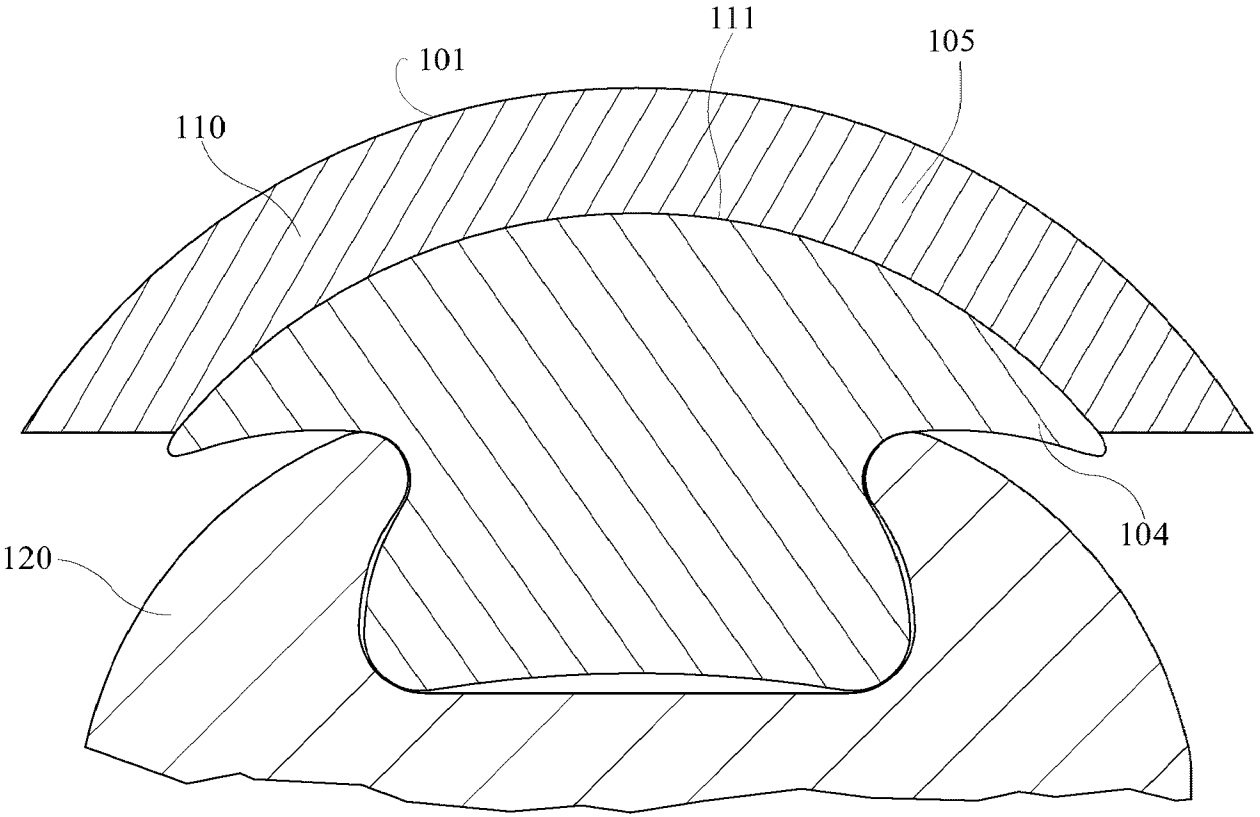
FIG. 4 is a cross-sectional view of a longitudinally extending portion of an installed watercraft light showing cooperation with a rub rail bumper.

FIG. 4 is a cross-sectional view of longitudinally extending portion 110 of installed watercraft light 101, taken along 4-4 of FIG. 2. Shown here is the cooperation of unitary longitudinally extending housing 105 with rub rail bumper 104, upon installation with a watercraft. Rub rail track 120 is shown holding an end portion of rub rail bumper 104. Longitudinally extending portion 110 has an inner surface 111 that is adjacent an outer surface of rub rail bumper 104. In this respect, longitudinally extending portion 110 covers cut ends of rub rail bumper 104 and may provide an outer longitudinal surface configured to become coincident with an outer longitudinal surface of the rub rail bumper 104.

Figure 5:
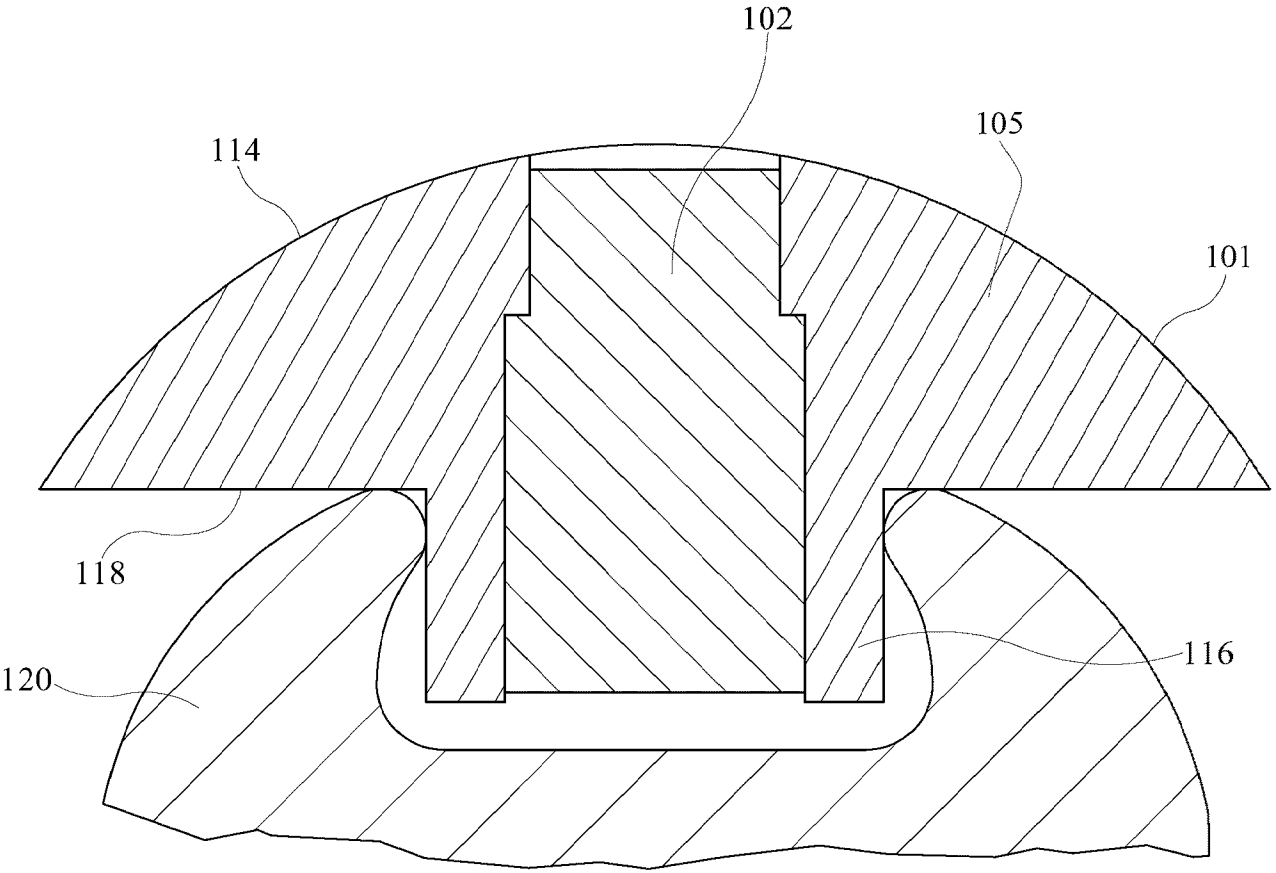
FIG. 5 is a cross-sectional view of an installed watercraft light showing cooperation with a rub rail track.

FIG. 5 is a cross-sectional view of a central portion of installed watercraft light 101, taken along 5-5 of FIG. 2. Watercraft light 101 has unitary longitudinally extending housing 105 holing at least one light 102 with rub rail track 120. Outwardly extending portion 116 extends from first side 118 and into rub rail track 120 and may hold a portion of at least one light 102. It is to be understood that unitary longitudinally extending housing 105 is configured to hold at least one light 102 substantially therein wherein none of the at least light 102 may extend beyond an outer perimeter of unitary longitudinal extending housing 105. In at least one aspect of the present disclosure, each light or lights 102 may be removable or replaceable. Portions of the at least one light 102 may be held with outwardly extending portion 116, portions of second side 114, or both, as shown in FIG. 5.

Figure 6:
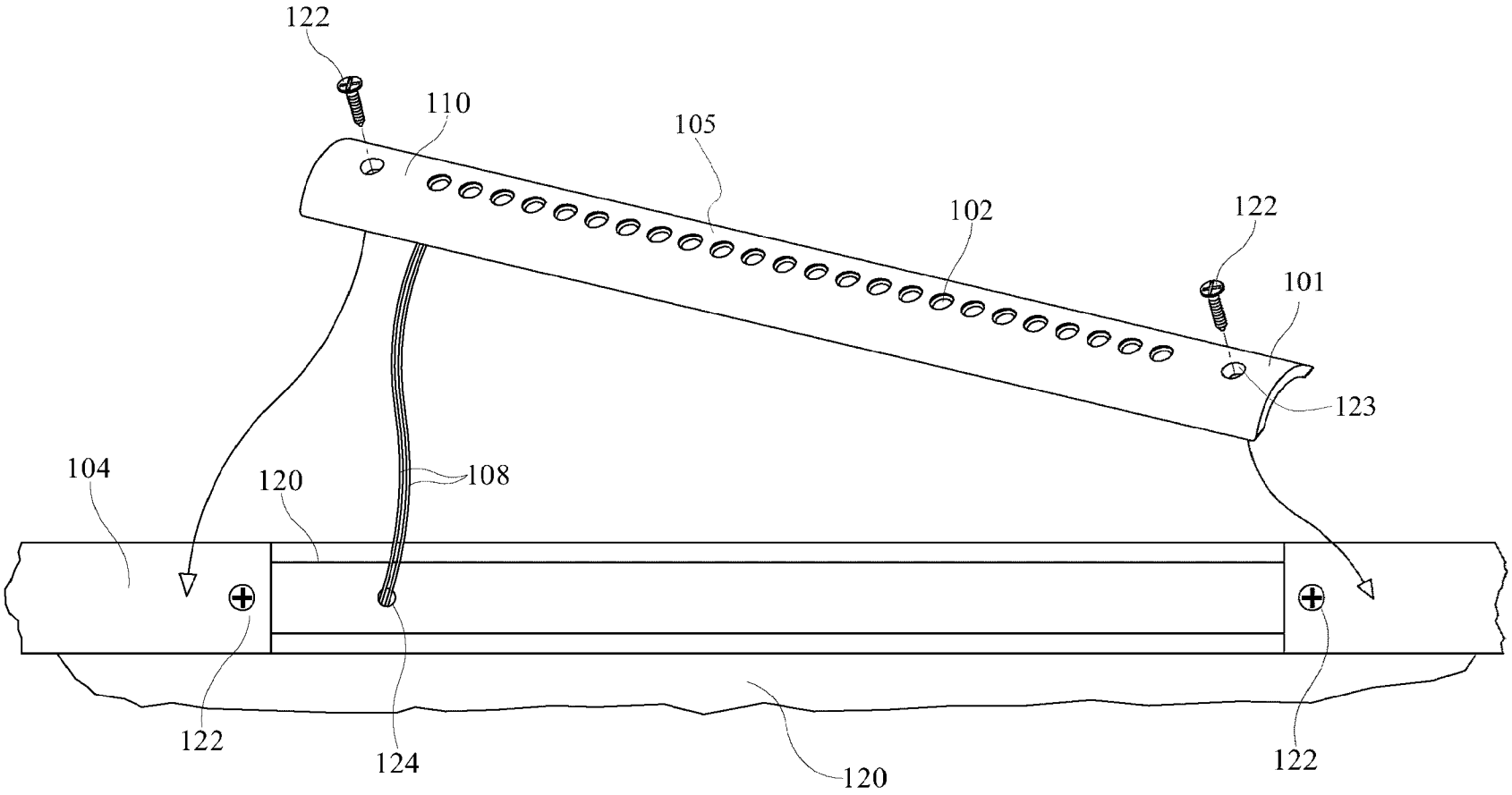
FIG. 6 is a perspective exploded view of the installed watercraft light shown in FIG. 2.

FIG. 6 shows an exploded view of installed watercraft light 101. A method of installing a watercraft light is presently disclosed with reference to FIG. 6. The method may comprise a first step of anchoring two spaced apart points of a rub rail bumper 104 in rub rail track 120 on a watercraft. Anchoring may be carried out with fasteners 122, as shown installed into the rub rail track 104 in FIG. 6. This step may be advantageously performed first with rub rail bumpers 104 that are elastic and under tension about the watercraft. The section of rub rail bumper 104 between the anchored points may then be removed by cutting and removing from rub rail track 120. The anchors, or installed fasteners 122, may prevent a tensioned elastic rub rail bumper 104 from contracting.

Upon removing a section of rub rail bumper 104 from rub rail track 120, an outwardly extending portion of watercraft light 101 may be inserted into the portion of rub rail track 120 having rub rail bumper 104 removed. The cut ends of rub rail bumper 104 may be covered with longitudinally extending portions 110 of watercraft light 101. Electrical lines 108 may be inserted through aperture 124 for electrically connecting watercraft light 101 to a power source. Watercraft light 101 may then be connected to the watercraft by fastening the longitudinally extending portions 110 of watercraft light 101, covering the cut ends of rub rail bumper 104, to the watercraft. For example, fasteners 122 may be extended through apertures 123 and fastened to the watercraft. Alternatively, or additionally, a portion of the outwardly extending portion 116 may be connected with rub rail track 120.

Figure 7:
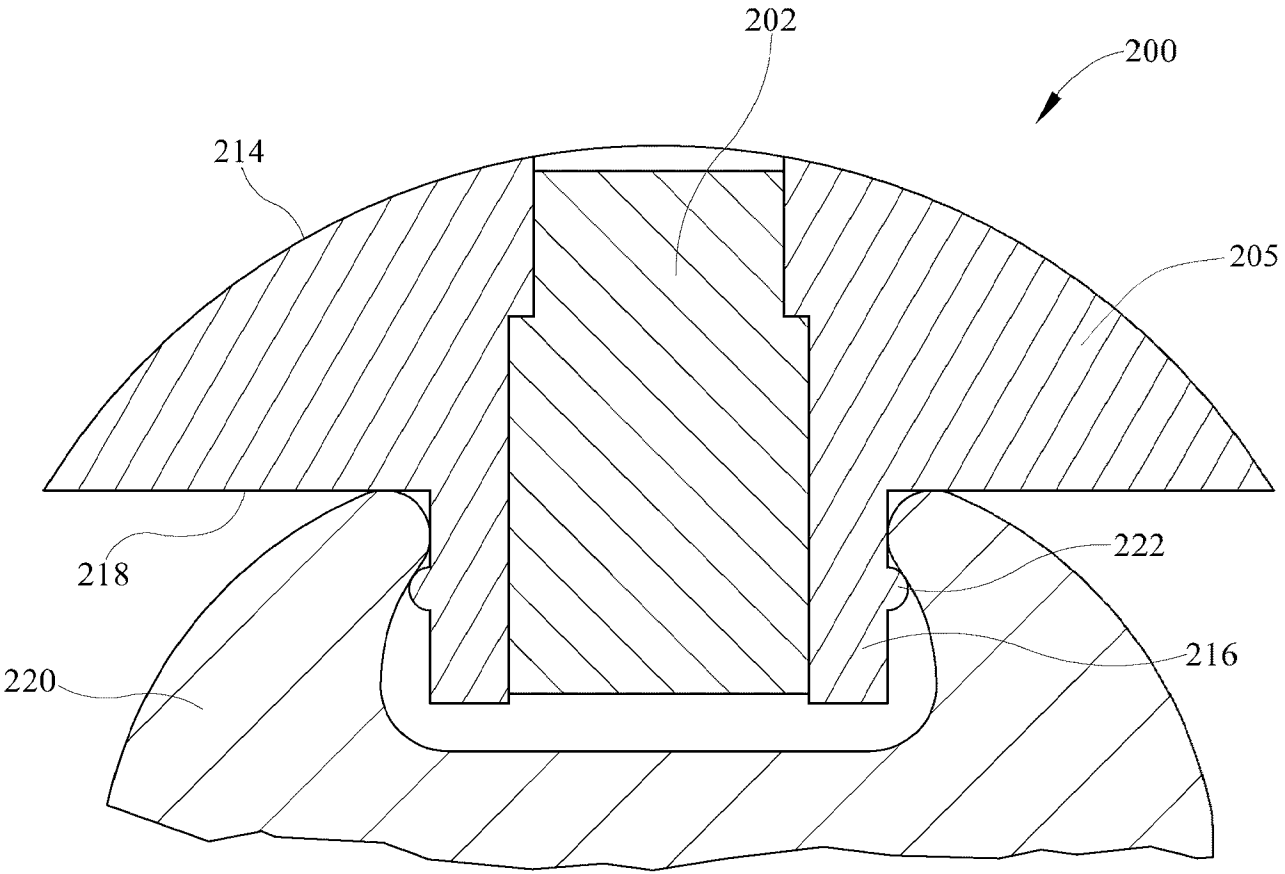
FIG. 7 is a cross-sectional view of an installed watercraft light of the present disclosure showing cooperation with a rub rail track.

FIG. 7 shows installed watercraft light 200 of the present disclosure showing cooperation with rub rail track 220. Watercraft light 200 has unitary longitudinally extending housing 205 holing at least one light 202 with rub rail track 220. Outwardly extending portion 216 extends from first side 218 and into rub rail track 220 and may hold a portion of at least one light 202. Portions of the at least one light 202 may be held with outwardly extending portion 216, portions of second side 214, or both. Protuberances 222 extend outwardly from outside surfaces of outwardly extending portion 216. Protuberances 222 may be in the form of one or more bumps or a longitudinally extending rib, longitudinally extending a length of unitary housing 205. Protuberances 222 may be configured and disposed to enable unitary housing 205 to be snapped into rub rail track 220. Protuberances 222 may also be configured to hold or connect unitary housing 205 with rub rail track 220 and may be used with other connecting or holding features. For example, unitary housing 205 may also have longitudinal extending portions, such as longitudinally extending portions 110, configured to be attached to the watercraft.

Features and aspects of embodiments of a watercraft light and a method of installation are disclosed herein. One feature or aspect of an embodiment is believed at the time of the filing of this patent application to possibly reside broadly in a watercraft light comprising at least one light substantially held within a unitary longitudinally extending housing. A first side of the housing may comprise an outwardly extending portion configured to be placed into a rub rail track, void of a rub rail bumper, between separate sections of the rub rail bumper. A second side of the housing may comprise longitudinally extending portions that extend beyond each of the longitudinal ends of the outwardly extending portion of the first side, each longitudinally extending portion may be configured to cover and become adjacent end portions of the separate sections of rub rail bumper. The second side of the housing is configured to transfer light from the at least one light to an area to be illuminated. The watercraft light may also have a connector configured to connect and hold the watercraft light to the watercraft.

Another feature or aspect of an embodiment is believed at the time of the filing of this patent application to possibly reside broadly in the connector comprising an aperture in each of the longitudinally extending portions of the second side and fasteners configured to extend through the apertures and the separate sections of a rub rail bumper and fasten the watercraft light to the watercraft.

Yet another feature or aspect of an embodiment is believed at the time of the filing of this patent application to possibly reside broadly in the connector comprising protuberances on the outwardly extending portion of the first side of the housing configured to be placed into a rub rail track and to connect and hold the watercraft light to the watercraft.

Still another feature or aspect of an embodiment is believed at the time of the filing of this patent application to possibly reside broadly in a watercraft light having a second side of a housing with an outer longitudinal surface configured to become coincident with an outer longitudinal surface of the rub rail bumper.

A further feature or aspect of an embodiment is believed at the time of the filing of this patent application to possibly reside broadly is a watercraft light having at least one aperture in a second side of its housing configured and disposed for transferring light from at least one light held its housing.

Another feature or aspect of an embodiment is believed at the time of the filing of this patent application to possibly reside broadly in a watercraft light having at least one LED.

Yet another feature or aspect of an embodiment is believed at the time of the filing of this patent application to possibly reside broadly a watercraft light comprising a plurality of lights wherein each light is substantially equally spaced from one another and disposed centrally with the watercraft light.

Still another feature or aspect of an embodiment is believed at the time of the filing of this patent application to possibly reside broadly in a watercraft light having an outwardly extending portion configured to be placed into a rub rail track between separate sections of a rub rail bumper and to hold the plurality of lights substantially therein and the outwardly extending portion comprises protuberances configured and disposed to cooperate with portions of a rub rail track.

A further feature or aspect of an embodiment is believed at the time of the filing of this patent application to possibly reside broadly in a unitary watercraft light housing configured to be held between sections of a watercraft rub rail bumper and to hold at least one light substantially therein. The watercraft light housing may comprising an outwardly extending portion configured to be placed into a portion of rub rail track void of a rub rail bumper and between separate sections of a rub rail bumper. The housing may have a portion of its outer surface configured and disposed to cover an outer surface of end portions of the separate sections of a rub rail bumper. The housing may also have a connector configured to connect and hold the watercraft light housing to the watercraft.

Another feature or aspect of an embodiment is believed at the time of the filing of this patent application to possibly reside broadly in a watercraft light housing having a connector comprising an aperture in each portion of its outer surface configured and disposed to cover an outer surface of an end portion of the separate sections of a rub rail bumper and fasteners configured to extend through the apertures and the separate sections of a rub rail bumper and fasten the watercraft light housing to a watercraft.

Yet another feature or aspect of an embodiment is believed at the time of the filing of this patent application to possibly reside broadly a watercraft light housing having an outer longitudinally extending surface configured to become coincident with a longitudinally extending surface of a rub rail bumper.

One feature or aspect of an embodiment is believed at the time of the filing of this patent application to possibly reside broadly in a watercraft light housing having at least one aperture configured and disposed for transferring light from at least one light, to an area to be illuminated.

Another feature or aspect of an embodiment is believed at the time of the filing of this patent application to possibly reside broadly in a watercraft light housing having an outwardly extending portion configured to be placed into a portion of rub rail track, void of a rub rail bumper, and to hold at least one LED.

Yet another feature or aspect of an embodiment is believed at the time of the filing of this patent application to possibly reside broadly in a watercraft light housing having an outwardly extending portion configured to be placed into a portion of rub rail track, void of a rub rail bumper, and to hold a plurality of lights wherein each light is substantially equally spaced from one another and disposed centrally with the watercraft light housing.

Still another feature or aspect of an embodiment is believed at the time of the filing of this patent application to possibly reside broadly in a watercraft light housing having an outwardly extending portion configured to be placed into a rub rail track between separate sections of a rub rail bumper and to hold a plurality of lights substantially therein, the outwardly portion comprises protuberances configured and disposed to cooperate with a rub rail track. The protuberances may be configured to hold the watercraft light housing in a rub rail track.

A further feature or aspect of an embodiment is believed at the time of the filing of this patent application to possibly reside broadly in a watercraft light housing having outwardly extending portion comprising gap spaced, substantially parallel longitudinally extending ribs configured to be placed into a rub rail track.

Another feature or aspect of an embodiment is believed at the time of the filing of this patent application to possibly reside broadly in a method of installing a watercraft light. The method may comprise first anchoring two spaced apart points of a rub rail bumper in a rub rail track on a watercraft. A portion of the rub rail bumper between the anchored points may then be cut and removed from the rub rail track. An outwardly extending portion of the watercraft light may then be inserted into the portion of the rub rail track having the rub rail bumper removed. The cut ends of the rub rail bumper may be covered with longitudinally extending portions of the watercraft light. The watercraft light may be connected to a power source and connected to the watercraft.

Yet another feature or aspect of an embodiment is believed at the time of the filing of this patent application to possibly reside broadly in a method of installing a watercraft light to a watercraft by fastening longitudinally extending portions of the watercraft light, covering the cut ends of the rub rail bumper, to the watercraft.

Still another feature or aspect of an embodiment is believed at the time of the filing of this patent application to possibly reside broadly in a method of installing a watercraft light by snapping protuberances on an outwardly extending portion of a first side of the housing into a rub rail track.

A further feature or aspect of an embodiment is believed at the time of the filing of this patent application to possibly reside broadly in a method of installing a watercraft light by first threading screws through the rub rail bumper and into the rub rail track or watercraft, at the spaced apart points, thus anchoring two spaced apart points of a rub rail bumper in a rub rail track.

Nomenclature

| | |
|---|---|
| Watercraft light | 100, 101, 200 |
| Light | 102 |
| String of lights | 103 |
| Rub rail bumper | 104 |
| Unitary longitudinally extending housing | 105 |
| Watercraft | 106 |
| Unitary longitudinally extending housing | 107 |
| Electrical line | 108 |
| Longitudinal extending portion of watercraft light | 110 |
| Surface of watercraft light housing adjacent rub rail bumper | 111 |
| Beveled end | 112 |
| Second side of watercraft light | 114 |
| Outwardly extending portion of first side of watercraft light | 116 |
| First side of watercraft light | 118 |
| Rub rail track | 120 |
| Fastener | 122 |
| Fastener aperture | 123 |
| Aperture for electrical line | 124 |
| Light | 202 |
| Unitary longitudinally extending housing | 205 |
| Second side of watercraft light | 214 |
| Outwardly extending portion of first side of watercraft light | 216 |
| First side of watercraft light | 218 |
| Rub rail track | 220 |
| Protuberance | 222 |

The invention claimed is:

1. A watercraft light comprising:

at least one light;

a unitary longitudinally extending housing holding the at least one light substantially therein and having a first side and a second side;

the first side of the housing comprises an outwardly extending portion configured to be placed into a rub rail track between separate sections of a rub rail bumper;

the second side of the housing comprises longitudinally extending portions that extend beyond each of the longitudinal ends of the outwardly extending portion of the first side, each longitudinally extending portion is configured to cover and become adjacent end portions of the separate sections of the rub rail bumper;

the second side of the housing being configured to transfer light from the at least one light to an area to be illuminated;

a connector configured to connect and hold the watercraft light to the watercraft.

2. The watercraft light of claim 1 wherein the connector comprises an aperture in each of the longitudinally extending portions and fasteners configured to extend through the apertures and the separate sections of the rub rail bumper and fasten the watercraft light to the watercraft.

3. The watercraft light of claim 1 wherein the connector comprises protuberances on the outwardly extending portion of the first side of the housing configured to be placed into the rub rail track and to connect and hold the watercraft light to the watercraft.

4. The watercraft light of claim 1 wherein the second side of the housing has an outer longitudinal surface configured to become coincident with an outer longitudinal surface of the rub rail bumper.

5. The watercraft light of claim 1 wherein the second side of the housing has at least one aperture configured and disposed for transferring light from the at least one light.

6. The watercraft light of claim 1 wherein the at least one light comprises at least one LED.

7. The watercraft light of claim 1 comprising a plurality of lights wherein each light is substantially equally spaced from one another and disposed centrally with the watercraft light.

8. The watercraft light of claim 7 wherein the outwardly extending portion configured to be placed into the rub rail track between separate sections of the rub rail bumper and to hold the plurality of lights substantially therein, the outwardly extending portion comprises protuberances configured and disposed to cooperate with portions of the rub rail track.

9. A longitudinally extending unitary watercraft light housing configured to be held in a rub rail track, between sections of a rub rail bumper, and to hold at least one light substantially therein, the watercraft light housing comprising:

an outwardly extending longitudinal portion configured to be placed into a portion of the rub rail track void of the rub rail bumper, between separate sections of the rub rail bumper;

the housing having end portions of its outer surface configured and disposed to cover an outer surface of end portions of the separate sections of the rub rail bumper extending out of the rub rail track; and a connector configured to connect and hold the watercraft light housing to the watercraft.

10. The watercraft light housing of claim 9 wherein the connector comprises an aperture in each of the end portions of the outer surface of the housing configured and disposed to cover the outer surface of the end portions of the separate sections of the rub rail bumper and fasteners configured to extend through the apertures and the separate sections of the rub rail bumper and fasten the watercraft light housing to the watercraft.

11. The watercraft light housing of claim 9 having an outer longitudinally extending surface configured to become coincident with a longitudinally extending surface of the rub rail bumper.

12. The watercraft light housing of claim 9 having at least one aperture configured and disposed for transferring light, from the at least one light, to an area to be illuminated.

13. The watercraft light housing of claim 9 wherein the outwardly extending portion configured to be placed into a portion of the rub rail track, void of the rub rail bumper, is configured to hold at least one LED.

14. The watercraft light housing of claim 9 wherein the outwardly extending portion configured to be placed into a portion of the rub rail track, void of the rub rail bumper, is configured to hold a plurality of lights wherein each light is substantially equally spaced from one another and disposed centrally with the watercraft light housing.

15. The watercraft light housing of claim 9 wherein the outwardly extending portion configured to be placed into the rub rail track between separate sections of the rub rail bumper and to hold the plurality of lights substantially therein comprises protuberances configured and disposed to cooperate with the rub rail track.

16. The watercraft light housing of claim 9 wherein the outwardly extending portion comprises a gap space, between substantially parallel longitudinally extending ribs and is configured to be placed into the rub rail track.

17. A method of installing a watercraft light comprising the steps of:

anchoring two spaced apart points of a rub rail bumper in a rub rail track on a watercraft;

cutting and removing a portion of the rub rail bumper from the rub rail track, the portion being between the anchored points;

inserting an outwardly extending portion of the watercraft light into the portion of the rub rail track having the rub rail bumper removed;

covering the cut ends of the rub rail bumper with longitudinally extending portions of the watercraft light;

electrically connecting the watercraft light to a power source; and connecting the watercraft light to the watercraft.

18. The method of installing a watercraft light of claim 17 wherein the step of connecting the watercraft light to the watercraft comprises fastening the longitudinally extending portions of the watercraft light, covering the cut ends of the rub rail bumper, to the watercraft.

19. The method of installing a watercraft light of claim 17 wherein the step of connecting the watercraft light to the watercraft comprises snapping protuberances on the outwardly extending portion of the watercraft light into the rub rail track.

20. The method of installing a watercraft light of claim 17 wherein the step of anchoring two spaced apart points of the rub rail bumper in the rub rail track on the watercraft comprises threading screws through the rub rail bumper and into the rub rail track or the watercraft, at the spaced apart points.

* * * * *